US006227969B1

(12) United States Patent
Yoseloff

(10) Patent No.: US 6,227,969 B1
(45) **Date of Patent: *May 8, 2001**

(54) MATCH SYMBOL SIDE BET GAME

(75) Inventor: Mark L. Yoseloff, Henderson, NV (US)

(73) Assignee: Shuffle Master, Inc., Eden Prairie, MN (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/157,971

(22) Filed: Sep. 21, 1998

(51) Int. Cl.[7] ..... A63F 1/00

(52) U.S. Cl. ..... 463/13; 463/12; 463/20; 273/292; 273/309; 273/143 R; 273/274

(58) Field of Search ..... 273/292, 274, 273/245, 256, 309, 305, 138.2, 146, 142.13, 306, 353, 149 R, 138.1, 139, 242, 243; 463/10, 16, 17, 13, 12, 18, 19, 20, 25, 27, 26, 22

(56) References Cited

U.S. PATENT DOCUMENTS

| | | | | |
|---|---|---|---|---|
| 4,861,041 | | 8/1989 | Jones et al. | 273/292 |
| 5,019,973 | | 5/1991 | Wilcox et al. | 364/412 |
| 5,033,744 | | 7/1991 | Bridgeman et al. | 273/85 |
| 5,098,107 | | 3/1992 | Boylan et al. | 273/292 |
| 5,288,077 | | 2/1994 | Jones | 273/292 |
| 5,364,105 | | 11/1994 | Jones | 273/292 |
| 5,377,973 | | 1/1995 | Jones et al. | 273/85 CP |
| 5,431,407 | * | 7/1995 | Hofberg et al. | 273/292 |
| 5,452,899 | | 9/1995 | Skratulia et al. | 273/292 |
| 5,529,309 | | 6/1996 | Bartlett | 273/292 |
| 5,531,440 | | 7/1996 | Dabrowski et al. | 463/12 |
| 5,536,016 | | 7/1996 | Thompson | 273/269 |
| 5,577,731 | | 11/1996 | Jones | 273/292 |
| 5,584,485 | | 12/1996 | Jones et al. | 273/292 |
| 5,607,162 | | 3/1997 | Boylan et al. | 273/292 |
| 5,626,341 | | 5/1997 | Jones et al. | 273/292 |
| 5,632,485 | * | 5/1997 | Woodland et al. | 273/292 |
| 5,660,391 | | 8/1997 | Klasee | 273/292 |
| 5,660,393 | | 8/1997 | Dreger | 273/292 |
| 5,664,781 | | 9/1997 | Feola | 273/292 |
| 5,711,525 | * | 1/1998 | Breeding | 273/292 |
| 5,732,949 | * | 3/1998 | Josephs | 273/292 |
| 5,794,964 | | 8/1998 | Jones et al. | 273/309 |
| 5,795,225 | | 8/1998 | Jones et al. | 463/13 |

* cited by examiner

*Primary Examiner*—Michael O'Neill
*Assistant Examiner*—John M. Hotaling, II
(74) *Attorney, Agent, or Firm*—Mark A Litman & Associates, P.A.

(57) ABSTRACT

A side game with potential wagering is provided along with an underlying game. The side game may include the use of symbols or cards or card figures, and may be played live, on video gaming apparatus, or with a combination of live play and various display means, including, but not limited to, cathode ray tubes (monitors), light-emitting diodes (LED's), Liquid Crystal Displays (LCD's), plasma displays and other video gaming displays. A method of playing both an underlying game and a side bet game comprises the steps of:

a) playing an underlying game in which at least two cards are received and at least two cards are kept by a player at the end of an underlying game and at least one wager is placed by the player on the underlying game, b) a player placing a wager on a side bet game, c) providing to the view of the player at least two randomly generated cards which become a part of the side bet game, d) comparing the at least two cards kept at the end of the underlying game to the at least two randomly generated cards which become part of the side bet game, and e) determining a level of correspondence between the at least two cards kept at the end of the underlying game and the at least two randomly generated cards which become part of the side bet game.

Wagers may be placed at any time before, during or after play of the underlying game.

54 Claims, 5 Drawing Sheets

MATCH SYMBOL SIDE BET GAME

BACKGROUND OF THE INVENTION

1. Field of the Invention

The present invention relates to games, including games where symbols are assigned to a player in the play of a game, particularly card games, and more particularly to side bet games which are played in conjunction with primary or underlying games such as poker, whether in a live game or in a video game.

2. Background of the Art

Games have been played throughout history in which symbols are assigned to players, with symbols of particular rank or relationship determining relative value or strength of a player's position within play of the game. Such games include games of chance including the use of instrumentalities such as dice, tiles, cards, spinning wheels and reels (as in slot machines). The advent of computers and associated monitors and their use within the gaming industry has provided essentially unlimited potential for the expansion of games into different instrumentalities as well as providing the older, traditional instrumentalities in a different format. For example, many of the games of chance played with physical instrumentalities are now played in video format, such games including Mah Jong, blackjack, craps, virtual reel slots, dominoes, poker, and games invented specifically for play on video screens.

Many versions of video draw poker have been around for years. Essentially, all electronic versions are played as follows, with minor variations: Five cards are dealt faceup to the player, the cards typically being randomly drawn from a single deck of fifty-two cards. The player selects which cards he or she likes, and discards the rest. To help in executing this selection, there are five "hold/cancel" buttons, one associated with each card position. The player selects a card to keep by pressing the hold/cancel button. If for some reason the player wants to change the card selection, he or she presses the hold/cancel button again. The player selects from zero cards to a maximum of five cards to be replaced in a five card originally dealt hand. The word "hold" is written on the video screen adjacent to (usually above) each selected card. The player discards the cards not indicated as on "hold" by pressing a draw or draw/deal button. New randomly selected cards from the residue of the fifty-two card deck are used to replace the discarded cards. After the player discards, certain final hands result in awards of money or credits. Posted pay tables determine the amount of player wins.

Manufacturers and casinos actively look for new and better versions of games such as video draw poker to maintain the interest of existing players and to introduce new players to exciting variations of the basic game. Some changes that have been tried include at least the following. Jokers and wild cards have been added to the card deck to enable higher hit frequencies for larger value hands to stimulate play. Some versions of video poker allow players to play double-or-nothing with all or a portion of awards after a winning hand. A "Second Chance" game, from Bally Manufacturing, allows the player to make another bet after the original round of card play has concluded. The player obtains one additional (sixth) card with a second chance to win.

Live house banked poker games, also termed pit poker games have encountered a significant revitalization at casinos. Part of the revival is the introduction of varieties of stud and draw poker games and progressive jackpots. Progressive jackpots are represented in the general casino gaming literature in U.S. Pat. Nos. 4,861,041; 5,377,973; 5,584,485; and 5,626,341 and specifically to games of Twenty-One in U.S. Pat. Nos. 5,288,077; 5,364,105; and 5,577,731. The underlying theme in the progressive jackpot games is that separate bets are initially made in an underlying game and a side wager on the appearance in the wagering player's hand of a predetermined arrangement of cards. U.S. Pat. Nos. 5,794,964 and 5,795,225 describes a method and apparatus for including a jackpot component as an additional feature in a live casino game.

U.S. Pat. No. 5,033,744 describes a new poker game, specifically a poker game with a draw or card replacement step, in a video game where a specific card is "zapped" or eliminated and a replacement provided, even if it is the intent of the player to zap or replace more than a single card. Rather than committing all cards to replacement, a decision may be made on each card in the sequence of zap and replace. This may provide the player with an option of changing strategies as each replacement card is dealt.

To increase the excitement and entertainment of the player and to offer games to the player, side bet games have been developed, both for live gaming and for video gaming. In some situations, awards for the side bet games may be independent of the rank of the dealt hand in the primary game. A common feature in some poker games is the addition of a progressive jackpot, as described in U.S. Pat. Nos. 4,861,041; 5,377,973; 5,584,485; and 5,626,341 and specifically to games of Twenty-One in U.S. Pat. Nos. 5,288,077; 5,364,105; and 5,577,731. These patents generally show that a progressive, and possibly much higher value jackpot, may be won by a player by making a separate and independent wager at the beginning of the primary game (before cards are dealt). This separate wager is won if predetermined arrangements of cards, such as certain poker hands of rated value (usually at least three-of-a-kind, straight, flush, full house, four-of-a-kind, straight flush and royal flush), are achieved in the play of the hand. The highest progressive jackpot value is usually won when the player obtains a royal flush, either with the cards in a specific order (e.g., A K Q J 10, also referred to as a "positional win") or in a random order (e.g., with the cards A K Q J 10 appearing in any arrangement or order). With the separate bet being placed, the jackpot or special award for the player achieving a rated (higher value) hand is paid in addition to awards won in the play of the primary game. This separate wager, however, is still won only when the player exhibits a hand with a relatively high poker value. A predetermined arrangement of cards which is independent of play in the underlying game could be, for example, a rank of a poker hand achieved in the play of a hand of Twenty-One, four aces in a Twenty-One game, or a Twenty-One point count total achieved in a poker hand. An example of a predetermined arrangement of cards which is dependent upon play of the underlying game could be, for example, specific ranks of poker hands (e.g., four-of-a-kind or straight flush) achieved during play of an underlying poker game.

Another type of gaming feature is shown in video poker with the side bet game of "Double Down." In this type of video poker or electronic poker, after a winning hand is achieved, a player may make a further wager of part or all of the award from the play of the primary game. This further wager may be made, for example, against an arrangement of five cards which appears identical to the back of five cards to be dealt in a five stud poker hand. If the further wager is made, the game is played as follows. Usually the first card (as counted from the left of the five cards whose backs only are displayed) is turned face-up after the wager is made, this card becoming the dealer's or the house's hand. The player may then select any single card from among the four cards which remain face-down, attempting to select a card having a higher face value than the dealer's card or the house's hand. If the card selected by the player exceeds the value of the dealer's card, the wager (an even money bet) is won by the player. Conversely, if the card selected by the player is of lower rank or value than the dealer's hand, the wager is lost. Ties are treated as non-decisions, and another wager based upon the original award from the primary game may be made or waived. This game may usually be played only when the player has achieved a winning hand and has an award which may be wagered in the side bet, or more properly termed in this game, a post game wager.

U.S. Pat. No. 5,019,973 describes a method of playing poker in which after a primary game (e.g., five card stud) is played on a video gaming machine, a second wager may be placed to enter into an additional game. In this additional game, another card is dealt from the deck of cards, and this another card is compared to the cards in the original and final hand. If the another card matches the value of one or more cards in the original final hand, all of the matched cards are changed in value to a wild card, and the hand is re-evaluated for the purpose of determining awards. The second wager is made on an additional poker game, based upon the cards used in the original poker game.

U.S. Pat. No. 5,660,391 describes a blackjack side bet game method in which a separate bet is made that a hand will be attained with a value of blackjack, 21, 20, 19 or 18 from a preliminary hand of four cards. After the wager, the player accepts the four cards and assembles the best possible blackjack hand. If that hand matches the wager placed upon the value of the hand to be attained, there is a payout to the player.

U.S. Pat. No. 5,098,107 describes a method and apparatus for playing a wagering game in which there is a primary line of play of a game whose outcome is determined by a selection of randomly generated symbols. A side bet is placed against the appearance of a plurality of additional, preferably no-value symbols. A separate wager may be placed upon a chance occurrence of at least two of the additional symbols being selected during normal play of the initial wagering game. A card game may be used as the underlying game, whether live or in video gaming formats.

U.S. Pat. No. 5,664,781 describes a method and apparatus for playing a poker type game in which wagers are made by at least one player as successive rounds of cards are dealt in the formation of a plurality of poker hands. Some of the wagers are made prior to the initially dealt card and possibly with each successive card.

U.S. Pat. No. 5,431,407 describes a method of playing a casino card game in which a wager is made that player selected cards are not going to be matched as cards from a separate deck are displayed. The players win if a predetermined number of 'sufficient' cards are displayed without a match, and the house wins if there is a match within that sufficient number of displayed cards.

U.S. Pat. No. 5,660,393 describes a method of playing a card-based wagering game. An underlying card game with wagering is played, and a side bet game is also played. The side bet game is played by the player making an independent wager (a card wager as opposed to a game wager) on a range of possible cards, a particular card of any suit, any card of a particular suit, a particular card of a particular suit or any combination of the above. In the preferred embodiment, the wager is made on the appearance of a card within three separate ranges of value (e.g., cards of six and lower, cards of value 7, 8 and 9, and cards of value ten or higher. The card wager appears to be required prior to the beginning of any of the games.

U.S. Pat. No. 5,529,309 describes a card game, similar to baccarat, in which a side bet is also allowed. The side bet is based upon a wager that the dealer's hand and the player's hand will have the same, non-zero value at the end of play. The wager is described as being made before play of the hands has begun, that is, prior to the deal.

U.S. Pat. No. 5,607,162 describes a method of playing a matching card game. Hands are dealt by randomly generated distributions of cards to players and to a dealer. More than one deck must be used in play, with an individual deck for the dealer or with multiple decks, the reasons becoming apparent with the play of the game. The dealer turns up his cards in sequence, and the players turn cards face down when the cards match. The player wins a wager if all of the player's cards are turned face down, and the house wins the wager if any of the cards remain face up. Poker hands above a specific value (e.g., above three-of-a-kind) are also awarded. The wager is made prior to the deal or exposure of cards in the hands. A single ante bet is placed at the beginning of the game.

U.S. Pat. No. 5,452,899 describes a method of playing a wagering game in which players select sets of winning numbers. Players place wagers, the dealer provides two cards face-up to the players, and then compares the value of the two cards with the selected sets of winning numbers, the dealer awarding a prize to the player whose winning numbers include the numeric sum of the face-up cards. If the two face-up cards are equal to two predetermined key cards, the dealer and players may implement a bonus playing procedure.

U.S. Pat. No. 5,531,440 describes a "Double Poker" game in which a player is initially dealt two distinct poker hands after an initial wager. The play of the hand may include the player selecting only one of the poker hands to be played. The game may also include an additional game in which, where there is a first and second hand, the player is awarded a predetermined amount if one or more cards from the first hand (e.g., a five card stud hand) match one or more cards from the second hand (either in number, number and suit, and/or position). The matching of cards may also be associated with a progressive payout or progressive jackpot, particularly in a video gaming machine. The play of the game is based upon the initial wager in the primary game, and the wager must be made before both of the hands are dealt.

Each of these games provides interest and entertainment to the players, but it is desirable to be able to provide additional forms of entertainment and awards to players.

SUMMARY OF THE INVENTION

A side bet component to a game providing multiple symbols, preferably in the form of cards, is provided in combination with a primary or underlying game. A distinctly novel characteristic of the side bet game is that the side bet may be made at any time before, during or after play of the underlying game, including before assignment of symbols or deal of the cards (the term cards will be used although the game is understood to include other symbols), after the deal of any of the cards, after the deal of all of the cards, before the resolution of the underlying game, and after resolution of the underlying game. The side bet game may even be entered after both sets of cards (the underlying play cards and the set of cards to be matched) are dealt, as long as both sets are not completely exposed. This includes the extremes of the situations where a) the side bet cards to be matched may be exposed, and a player's cards are dealt but not completely exposed (to the player) and b) a player's hand is exposed completely, and the side bet cards to be matched are not completely exposed. The side bet game may be entered by a wager made before, at the same time or after any wager, ante or bet made in an underlying game. The side bet game encompasses the wager that randomly generated cards (including cards dealt from a shuffled deck) will provide a match with cards in the wagering player's hand when the randomly generated cards are disclosed. The randomly generated cards against which a match is sought, especially when a single deck (or virtual single deck) is used for the play of the underlying game, is usually dealt from an independent or separate deck of cards (virtual or real). A side bet is placed on the likelihood of the player matching randomly generated cards, and a resolution of the wager is made. The matching of specific numbers of cards (e.g., four or five out of a hand of five cards) may be used in a progressive jackpot. One unique attribute of the game is that a wager on a side bet game or a progressive game may be made after a portion or all the player's cards have been viewed and may be placed contemporaneously with a wager on the underlying game or after the underlying wager has been placed and play of the underlying game has begun. This side bet game is particularly compatible with poker games, either stud poker games, Pai Gow poker or draw poker games.

DETAILED DESCRIPTION OF THE INVENTION

Figure 1:
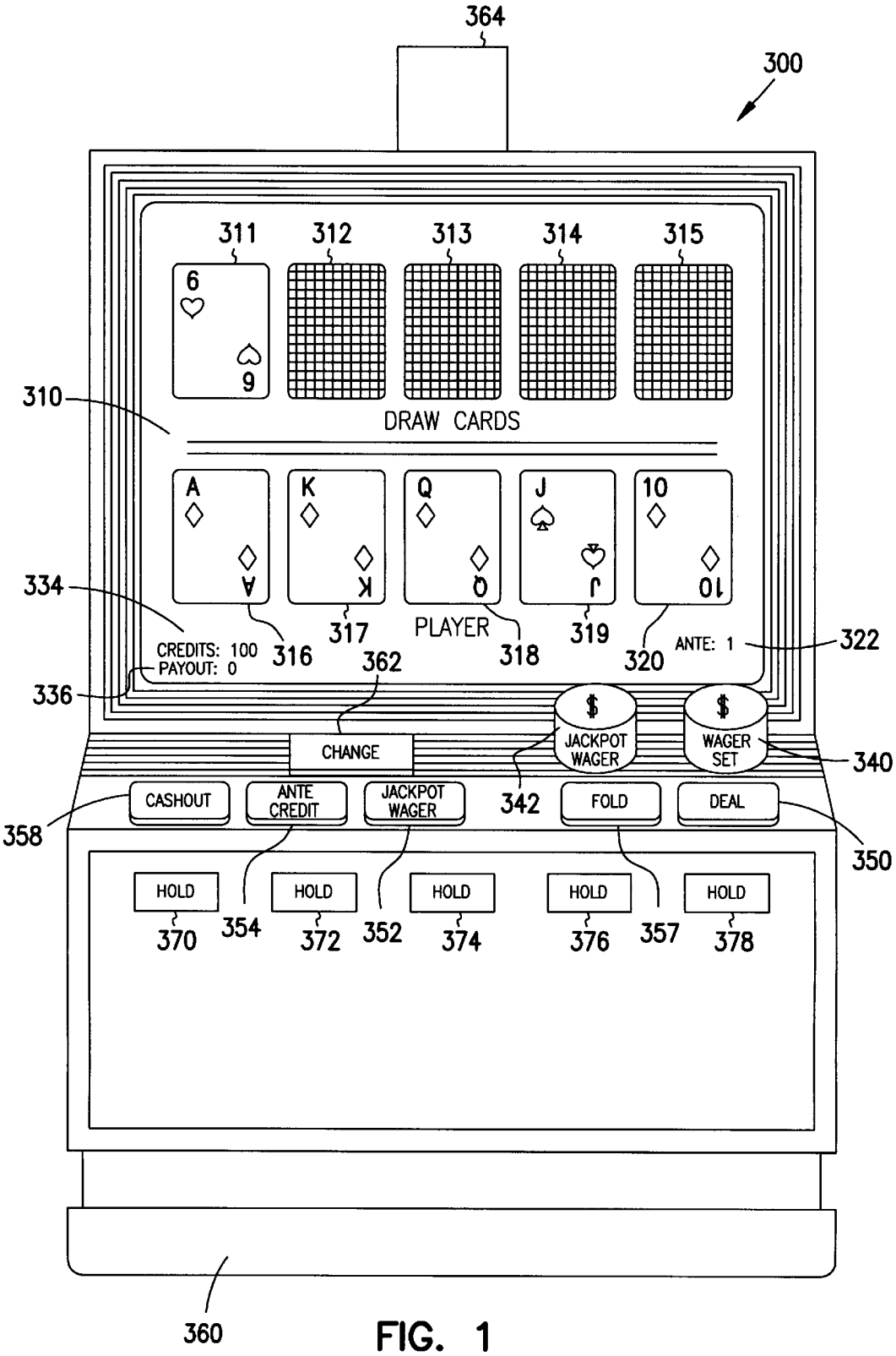
FIG. 1 shows a flow diagram of a method of practicing a process according to the present invention.

A side bet wagering component is added to an underlying game in a live table game or a video gaming apparatus. The underlying game provides multiple symbols (such as cards, tiles, symbols, numbers, figures and the like) to a player, with the normal rules and play of the underlying game occurring. The side bet game is determined from the disclosure by the dealer, usually from a source of randomly generated symbols independent from the source of the dealer's (if any) or the player's symbols, of a number or set of randomly generated symbols. The player has, at any time prior to the disclosure by the dealer of the set of randomly generated symbols, made a wager that his cards (whether dealt, viewed or played at that time) will match a portion or all of a set of randomly generated symbols. The resolution of the side bet wager may be made before, contemporaneously with, or after the resolution of the underlying game wager.

Although the side bet game may be played with any other underlying or primary game which receives multiple symbols, explanation of the side bet game of the present invention herein is conveniently explained with reference to five card stud poker and five card draw poker. Each of these five card games ends with the player having five cards remaining in the player's hand. A wager may be made at any time before play is initiated, during play of the five card poker game, after play has ended, before resolution of the underlying game bet, or after resolution of the underlying game bet. At any time when the player is committed to a specific five cards, the five cards dealt to the house or to the dealer to be matched may be disclosed (the cards dealt to the house or to the dealer shall be referred to herein as "match cards"). As previously mentioned, the side bet game may be engaged or entered across a wide spectrum of events in the play of the underlying game. For example, the side bet game may be entered when a) the side bet cards to be matched have been exposed, and a player's cards are dealt but not completely exposed (to the player) and b) a player's hand has been exposed completely, and the side bet cards to be matched have not been completely exposed. That is, the side bet wager may be placed at any time where there are two hands (e.g., the player's underlying game hand and the side bet match cards), and before, during or after exposure of a first hand, up to the time that no portion or only a portion of a second of the two hands has been exposed (usually no portion may be disclosed, but possibly the second hand may be partially disclosed). It is unlikely that the playing rules would allow the match card hand to be viewed before a player has discarded and withdrawn cards from the player's hand during a draw poker game. Although this could be allowed, that type of activity could overly influence the normal play of the underlying poker game or other underlying game.

The present invention generally provides for a method of playing both an underlying game and a side bet game comprising the steps of:

a) playing an underlying game in which at least one and preferably at least two symbols are received and at least one and preferably at least two symbols are kept by a player at the end of an underlying game and at least one wager is placed by the player on the underlying game, b) a player placing a wager on a side bet game, c) providing to the view of the player at least one or at least two randomly generated symbols which become a part of said side bet game, d) comparing said at least one or at least two symbols kept at the end of the underlying game to the at least one or at least two randomly generated symbols which become part of the side bet game, and e) determining a level of correspondence between said at least one or said at least two symbols kept at the end of the underlying game and the at least one or the at least two randomly generated symbols which become part of the side bet game.

These steps and other steps listed herein in a sequence are not necessarily limited to the order in which they are described above, as noted in the fact that the side bet may be made at any time before, during or after the play of the underlying game, as well as other variations in sequence which do not make the side bet wager an absolutely assured win (e.g., after both hands have been completely exposed).

More specifically, the present invention relates to a method of playing both an underlying game and a side bet game comprising the steps of:

a) playing an underlying game in which at least one and preferably two cards are received and at least one and preferably two cards are kept by a player at the end of an underlying game and at least one wager is placed by the player on the underlying game, b) a player placing a wager on a side bet game, c) providing to the view of the player at least one and preferably two randomly generated cards which become a part of said side bet game, d) comparing said at least one and preferably two cards kept at the end of the underlying game to the at least one and preferably two randomly generated cards which become part of the side bet game, and e) determining a level of correspondence between said at least one and preferably two cards kept at the end of the underlying game and the at least one and preferably two randomly generated cards which become part of the side bet game.

The method may be practiced wherein after determining a level of correspondence between said at least two cards kept at the end of the underlying game and the at least two randomly generated cards which become part of the side bet game, comparing that level of correspondence to a look-up table. Also, after comparing that level of correspondence to a look-up table, a rate of award to be provided to that level of correspondence may be identified. After a rate of award to be provided to that level of correspondence is identified, an indication of a total amount of award or bonus is indicated to the player. The wager on the side bet game may be placed before, after or at the same time as a wager on the underlying game. It is possible that the wager on said side bet game is placed when no card has been received by the player or after at least one card in the underlying game is received by the player. It is also possible to place the wager on said side bet game after at least two, three, four, five, six or seven cards are received by the player.

The wager on the side bet game may engage the player in an opportunity to be a contestant in a progressive jackpot or a fixed payment jackpot. The preferred method takes place where the underlying game is stud poker with at least five cards received by the player in the underlying game. The method may be practiced where the underlying stud poker game provides at least five cards and no more than seven cards to the player in the underlying game, and at least three randomly generated cards which become part of the side bet game are provided after or when a side bet wager is made.

The method is particularly practicable where the underlying game is five card stud poker, and at least three randomly generated cards which become part of the side bet game are provided after or when a side bet wager is made. The method is also attractive where the underlying game is five card stud poker, and five randomly generated cards which become part of the side bet game are provided (exposed) after or when a side bet wager is made.

In a typical five card stud game, the side bet wager of the present invention may be made and the side game may be played as follows:

a) Before the deal of any cards, a player may elect to make a side bet that, with respect to the player's final five cards, a match card hand of a predetermined number of cards (e.g., usually the same number as in the normal play of the hand, but the number and the attendant awards may be varied) provided to the dealer or otherwise displayed to the player will have a desired level of correspondence to the player's final five cards.

b) After the deal of one, two, three, four or five cards in the five card stud game, a player may elect to make the side bet wager, before resolution of the underlying five card stud game.

c) After dealing of all five cards to the player, the side bet wager is placed, either before, at the same time or after resolution of the underlying game wager.

d) At any time during the play of the five card stud game after the side bet wager has been placed, a randomly generated number (e.g., 1, 2, 3, 4, 5, 6 or more) of cards is provided as the side bet match cards. The cards in the player's hand are compared to the cards in the side bet match cards, and awards are provided depending upon the degree of correspondence of the cards in the player's hands with the cards in the side bet match cards.

There are many different types of correspondence in addition to the level of correspondence which the side bet game may offer towards awards. The type of correspondence may be selected from among any of the following, either separately or in combination:

1) Identical matching of values and suits,

2) Matching of 1, 2, 3, 4 or five (or more) cards,

3) Matching of values only (e.g., 3's, J's, etc.),

4) Matching of only suits of the cards, and

5) Matching of position of cards.

Different award levels may be provided depending upon the difficulty (probability) of a particular type of match. A progressive game may also be associated with the side bet game, with increasing jackpots for the hand or hands with the highest levels of difficulty (the lowest probability of occurrence). For example, the progressive jackpot may be awarded for matching the value, suit and position of five cards. This would be the lowest probability event, similar in style to requiring a match of a royal flush with a particular ordering of the cards in the royal flush. The correspondence may also include only the suits and values of the five cards (as where a royal flush is provided with the cards of the royal flush in random order than ascending or descending order). Matching awards may be provided for a specific number (one, two, three, four or five) of the five cards in the player's hand matching the suit, value and position of the cards in the match card hand or matching the suit and, value of the match cards. Any specific combination or orientation of cards may be used for award combinations. One of the enticements for the play of this side bet game is both its independence from the valuation of hands in the underlying game, and the potential for large awards (especially with a progressive pot) from the play of the side bet game.

Figure 2:
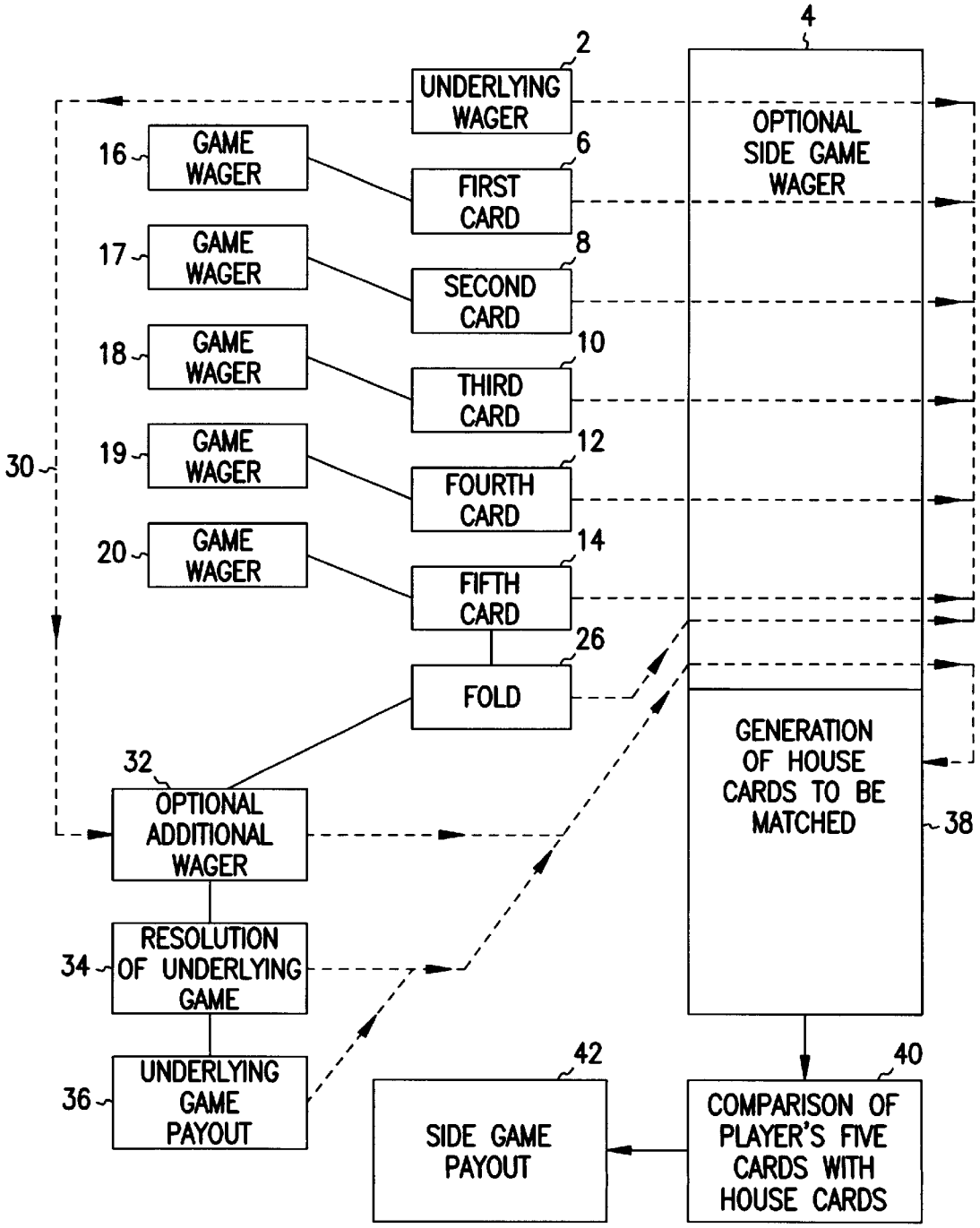
FIG. 2 shows a video gaming apparatus which may be used in the practice of the present invention.

In the play of the side bet game in conjunction with the underlying game, the flow diagram in FIG. 2 shows the possible ordering of steps in the play. An underlying wager or bet 2 is placed on the underlying game of five card stud. Before, at the same time or after this underlying wager 3, an optional side game wager 4 may be placed. This optional side game wager is usually an optional single event side game wager. That is, the side bet may be made only once during any single play of the underlying game, even if that optional single event side game wager 4 may be made at essentially any time.

The ordinary play of the underlying game usually comprises the dealing of cards after the underlying game wager 2 (or the ante). There are many different options in the play of five card stud. In one scenario, cards are dealt one-at-a-time (including the first card 6), and optional wagers are made after viewing the individual cards. Individual cards 6, 8, 10, 12, and 14 may be dealt out in sequence or all at one time. The optional underlying game wagers 16, 17, 18, 19 and 20 may be made after receiving those particular individual cards. Five card stud is traditionally played as a pooled wager game with optional wagering after the receipt of at least one card (after an ante) and with each successive card received. In house banked play of five card stud, the game may be played so that a wager is made up to and/or after receipt of the fourth card 12 by the player, shown by dotted line 30 in FIG. 1. After receipt of the fourth card 12, the normal options in the play of five card stud include folding 26 (withdrawing from the play of the hand and forfeiting all wagers to date) and placing an optional wager 32. The hand is then resolved (as against a dealers hand, another player's hand, or against fixed payoffs for specific values of hands (e.g., at least a pair, at least jacks-or-better, two pair, three-of-a-kind, etc.). The side bet game interleaves with the play of the underlying game by allowing the side game wager to be placed before, at the same time or after this underlying wager 3, an optional side game wager 4 may be placed, before, at the same time or after any individual card is received (before, at the same time or after an underlying wager 16, 17, 18, 19 and 20 is placed) on the underlying game after the receipt of individual cards 6, 8, 10, 12 and 14. The optional single event side game wager 4 may also be made before, at the same time or after folding 26, before, at the same time or after resolution of the underlying game 24, before, at the same time or after the award payout 36 of the underlying game. Once the single event side game wager 4 has been made, the generation of the match cards to be matched 38 may be performed. It is usually not amenable to the play of the underlying game to have a comparison of player's five (or fewer) cards and/or resolution of any award payout before completion of the underlying game 40 and award payout on the underlying game 42, but that is an option. Ordinarily, the generation of match cards to be matched is done when the five final cards of the player are in place 14. Comparison of the match cards with the final five player's cards 40 an any attendant payout 42 usually occurs immediately before, at the same time or after resolution of the underlying game 34 and payout 36 on the underlying game. The award payout 42 may also include a comparison of the degree of matching between match cards and the players final five cards with special jackpot features and/or a progressive jackpot. Where the underlying card game may not initially provide sufficient numbers of cards for play with larger numbers of cards to be matched in the side bet match game, as in Twenty-One, where there may be only four cards between the dealer's hand and a player's hand, the dealer's and player's hands may be combined (e.g., the first four cards dealt to the player and the dealer, the first five cards dealt to the player and the dealer, etc.) to provide a set of cards against which the side bet match cards are to be matched. This will assure that at least a certain number of cards (e.g., four in a Twenty-One game) will be available for use in a side bet match game. In this way, all or a portion of the dealer's hand and the player's hand may be combined to form an underlying player's hand for purposes of the side bet wager game. The side bet wager game may also be played with hands that have folded or broken. For example, a player in the game of Twenty-One may have cards totaling twenty-six, but may wish to engage in the side bet wager game. Even after breaking (exceeding Twenty-One in count), but before the cards are collected by the dealer or withdrawn by video apparatus, the side bet wager may be placed. Likewise, in a poker game where a player has an option of folding (or even where the dealer's hand after folding [as in Caribbean Stud™ poker, where a hand of rank less than A K is folded by the dealer] is chosen for the hand selected from the underlying game for matching separately provided match cards), a folded hand may be selected as the cards to be used in the side bet wager game in conjunction with the match cards.

The "side bet wager game" may also be played as an independent game. For example, a player may make a wager, without an underlying game, that there will be a level of correspondence between cards or symbols which are provided to the player and a randomly generated number (at least 1) of cards or symbols. Alternatively, a player could place a wager on the occurrence of a level of correspondence between a match card hand and the hand of another player. In either case, even without the play of the underlying game, the wager may be placed at any time before the second of the two hands (the side bet or other player's hand and the match card hand) is revealed. For example, the two sets of cards/symbols, 1) a player's hand of a number of cards or symbols may be dealt face down and 2) a number of side bet match cards may be dealt face down. Either (but not both) sets of symbols/cards may be turned to reveal the symbols or cards, and the side bet wager may have been placed at any time while the cards/symbols are being revealed in a first set. Wagers may be placed until such time as the cards/symbols of the second set are completely revealed, and preferably before the first symbol in the second set is revealed. It would not be reasonable to allow bets to be made after all of the cards/symbols in the second hand have ben revealed, as the outcome would then be apparent. It is not desirable to allow bets to be made after any portion of the second hand has been revealed for similar reasons, even though the complete outcome is not revealed.

Figure 5:
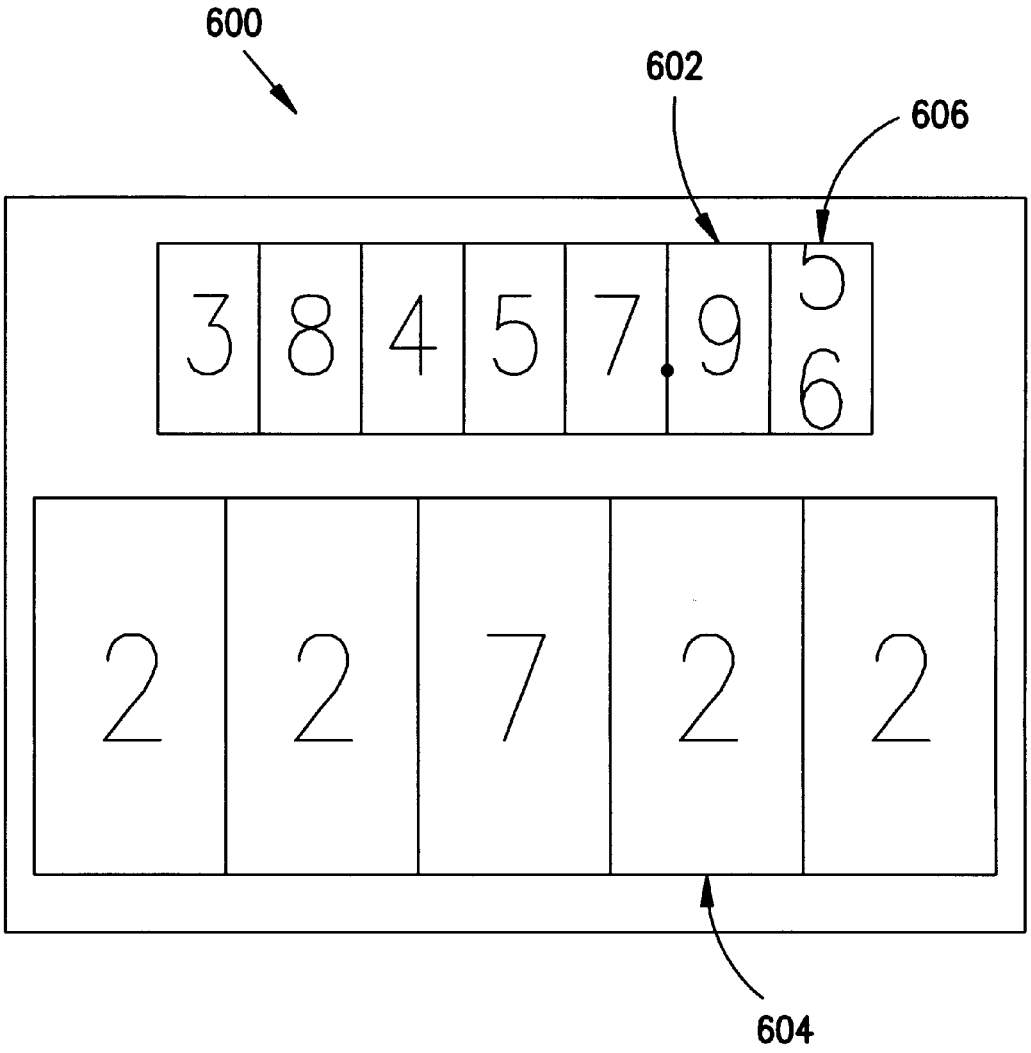
FIG. 5 shows a combined jackpot meter and side bet match symbol display.

The match symbol or match card hand may come from any available source or means for providing a random source of symbols or cards. For example, where there are multiple players, a single match card hand from a source of a complete set of symbols or cards (e.g., if a single deck is used for play of an underlying card game, it would not be useful to attempt to select the match card hand from the partially depleted single deck) may be used for matching the symbols or cards of each of the players exercising the option to play in the side bet wagering game. A single deck or multiple decks of cards (separate from that used in the underlying card game) may be used to provide the match card hand. A single deck, a collection of mixed decks, or multiple single decks may be used to provide individual match card hands to each player who has exercised an option to enter the side bet wager game (or who wishes to view the match card hand before having the player's hand revealed and before deciding to make a wager on the side bet game). Rather than physical decks of cards or collections of symbols, displays of symbols or cards may be used on a video monitor (or other CRT), LED screen or panel, LCD panel or screen, plasma screen or panel, or other image displaying device which can provide a visual representation of the symbols or cards. The random selection of symbols or cards would then be revealed on the image displaying device. The image displaying device may be used as part of a live casino game or part of a video apparatus. The image displaying device may be embedded in a live casino game table, attached to the table, combined with a progressive meter (as shown in FIG. 5), placed in proximity to the table or otherwise placed in view of the players. Where individual match card hands are to be provided to each player, the various image displaying devices should be placed in a position so that each device is associated with a particular player from among the multiple players who may be at a live casino table or contemporaneously playing on a single apparatus.

The game may be varied somewhat to accommodate five card draw, either live or on a video gaming apparatus, without shifting the advantage too far towards a player so that a casino would not wish to practice the game. In practicing the game with five card draw, the generation of the five match cards (or whatever number is generated) is, as with five card stud, done by random generation of the numbers. Where a player's hand or the hands of multiple players and the dealer are generated from a single deck (or single virtual deck), the match cards against which a match is attempted should be randomly generated From an independent or separate deck of cards (e.g., fifty-two cards having Ace through King of spades, Ace through King of hearts, Ace through King of diamonds and Ace through King of clubs). The variation in a game of draw is that the generation of the match cards should be done only after the final five cards of the player's draw hand have been fixed. This option can be waived, and the match cards can be generated before the discard and draw have been executed, but this can alter the natural play of the underlying game significantly. For example, if the player's dealt hand in five card draw is:

a full house, with the twos of hearts, spades and diamonds, and the kings of clubs and spades, and the match cards generated before the draw are:

three of a kind, with the twos of hearts, spades and diamonds, and the king of clubs and seven of diamonds, the player seeking to obtain the large payout or jackpot from a matching five card win would likely break up the natural full house to seek the seven of diamonds. Even though this would be a strategic move, the reduction of value of the natural hand coupled with the failure of the seven of diamonds to be the replacement card would not be pleasant to the player and could cause the player to feel disadvantaged at the play of the game. The most emotionally neutral play of the game with five card draw would therefore require waiting for the final hand to be completed (whether folded or raised) before revealing of the match cards.

In the play of the side bet game in video gaming apparatus, the following formatting of events in the final play might be desirable. The player's hand is placed in one column or one row, for example only, along the bottom of the screen at the conclusion of the underlying game. The match cards are placed in another position, either face up or face down, again for example, in a parallel column or row to the player's final five cards. The match cards are exposed, either one-by-one or all at one time. The match cards are rearranged with respect to matching of cards in the player's hand, and the matched cards in the player's hand are highlighted to emphasize the match.

In the play of the side bet wagering game along with an underlying game, the player has many options as to when the wager on the side bet game may be made. Assuming, for example, that the underlying game is a card game, the wager on the side bet game may be made:

a) before any initiation of play of the underlying game (e.g., before a wager on the underlying game is made, before any player's cards are provided, before any match or dealer cards are provided);

b) at the same time that a wager on the underlying game is made;

c) after any wager (including an ante or bet) has been made on the underlying game;

d) after any portion of the total cards to be provided to a player and/or house/dealer in the underlying game has been provided (e.g., only one card, only two cards, only three cards, only four cards, etc. up to a number of cards to complete the player's or dealer's hand);

e) before or after receipt of any total number of cards possibly received by the player and/or dealer in the underlying game are provided, and/or before or after any replacement cards or additional cards are provided;

f) any time before or after completion of place of the underlying game;

g) any time before or after any or all awards within the underlying game have been made;

h) before or after a player has removed a hand from active play in an underlying game (e.g., before or after folding, but before the cards have been removed from the table or removed from specific identified association with a player);

i) at any time when a specific number of cards from an underlying game are in the possession or control on the table of a player or dealer (e.g., a player may choose to place a wager on the side bet game on the hand of the dealer or another player); or j) at any time up until all or a part of the last of the two hands is revealed to the player.

Some of these alternative wager positions on the side, bet game may be referred to as 4. A wager is placed on side bet game before any cards are received by said player, a wager is placed on said side bet game after at least one card is received by said player, a wager is placed on said side bet game after at least one card is viewed by said player, a wager is placed on said side bet game after all cards used by a player in play of the underlying game have been received by said player, a wager is placed on said side bet game after all cards used by a player in play of the underlying game have been viewed by said player, a wager is placed on said side bet game after conclusion of play of the underlying game, and a wager is placed on said side bet game after conclusion of play of the underlying game and after payment of awards in said underlying game, and a wager is placed on said side bet game at any time until all of or a part of the last of the two hands is revealed to the player.

As shown in FIG. 1, in a video gaming apparatus 300 which may be used in the practice of the present invention, a monitor 310 provides a display of a dealt hand of five cards 316, 317, 318, 319 and 320 comprising the Ace of Diamonds, the King of Diamonds, the Queen of Diamonds, the Jack of Spades, and the Ten of Diamonds, respectively. This hand is assumed to be the final hand in the play of the cards for an underlying game of five card draw poker. The player may at any time in the play of this hand, as described in detail herein, elect to enter a wager to play in a jackpot game. The player may place a wager on the occurrence of additional cards matching the displayed hand of five cards 316, 317, 318, 319 and 320. The wager may be initiated, for example, by depositing coins in the jackpot wager receptor 342 or by pressing the jackpot wager key 352. A first draw card 311 in the match card side wager game is shown exposed on the monitor 310 after initiation of the game. Upon making the requisite payment, a side bet card 311 is displayed, either one at a time (as shown in FIG. 2) or all at once. By showing the side bet match cards one-at-a-time, a player may be allowed to withdraw a portion of the side bet wager from play, as is done with bets (broken down into three units) in Let-It-Ride™ poker.

A video gaming apparatus 300 for the poker game of this invention may have other special attributes and formatting. The standard features of credit display 334, individual hand payout 336, cashout key 358, ante or wager credit application key 354, coin deposit ante or wager bet coin deposit 340, coin return shelf 360 for payouts, change slot or paper currency slot, or charge card receptor 362, special bonus award light 364, fold key 357 (for certain poker games), deal/replace key 350, and five hold keys 370, 372, 374, 376, and 378 for each originally dealt player's cards 316, 317, 318, 319 and 320. Additional features and keys could also be provided. Other keys, not shown, might include a continue play key (where the first displayed option card has been accepted, but the hand and the play of the cards is not yet complete. The line of back up option cards 311 (shown in a face up position after a display event), 312, 313, 314 and 315 may also be provided in other locations other than above the player's hand. For example, the match card side wager cards may overlap or be inserted within the area of the screen with the player's hand, may appear under the player's hand, or be shown in a vertical column or diagonal column. The match game cards may be first displayed with their back sides facing up. This last feature provides to the player the appearance that the randomly provided replacement cards have already been committed to play, as if actual cards have been placed face down on a table and merely await being turned over. The match cards in the match card side wager game are, of course, provided from a separate complete set of symbols (e.g., a separate fifty-two card deck) than the symbols used in the play of the underlying hand.

Figure 3:
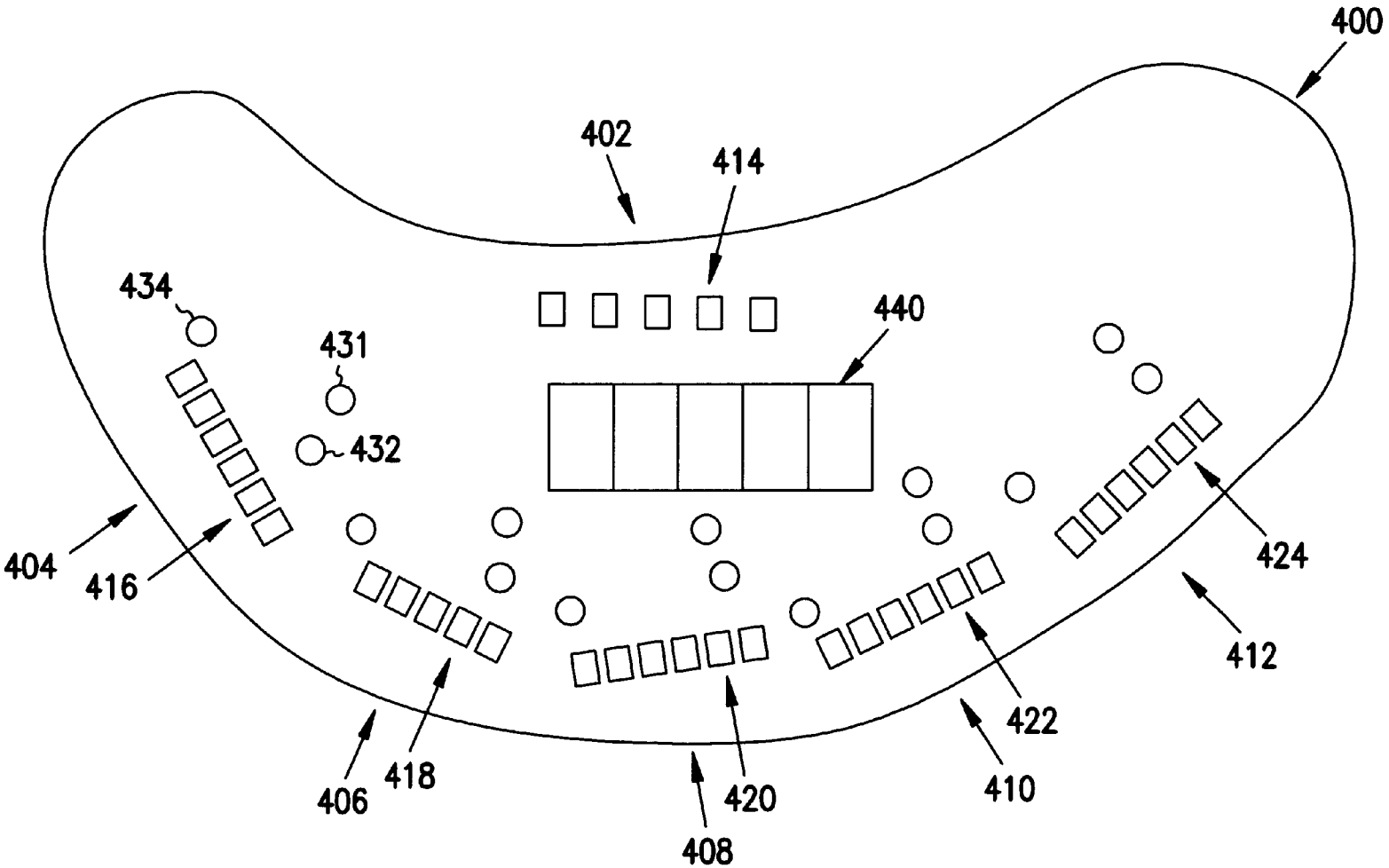
FIG. 3 shows a table for live players of a primary wagering game combined with a video display associated with the table for display of a match card hand.

FIG. 3 also shows another aspect of the present invention. A gaming table 400 is shown with a dealer's position 402, and five player positions 404, 406, 408, 410 and 412. Fewer or more player positions could, of course, be used. Each position 402, 404, 406, 408, 410 and 412, is shown for convenience of explanation with marked positions 414, 416, 418, 420, 422 and 424 for five cards. The five player positions 404, 406, 408, 410 and 412, may be provided with specially marked areas (as with player position 404) 430 and 432 for anteing, wagering or betting on the underlying game, and/or wagering on a separate side bet game associated with the underlying wagering game. A separately marked area 434 also may be provided for placing a wager on the match card side bet game according to the present invention. The specially marked area 434 preferably has an electronic indicator associated directly with the marking or positioned elsewhere (not shown) to identify the placement of the side bet wager by a particular player. For example, the specially marked area 434 may comprise an area of the table which can display a light or change in color or configuration when a wager on the side bet game has been placed. Preferably, a microprocessor (not shown) is included which energizes a visual indicator (such as a light, light extinction, flag or exposing panel) that the match card wager has been placed. The gaming table 400 is also shown with a video screen monitor) 440 which may be used to display a match card assortment of cards. The video screen 440 is shown in FIG. 3 as embedded in the gaming table 400. A monitor may be alternatively positioned as an upright monitor at any position on the table or around the dealer. Individual monitors in front of each of the five (or more or less) player positions 404, 406, 408, 410 and 412 may also be provided as an alternative format. Preferably whenever the play of the side bet wagering game is initiated, a match card hand (not shown) is presented on a monitor, such as monitor 440.

FIG. 5 shows a visual display panel 600 for display of a progressive jackpot and display of a match symbol (e.g., match card) hand. The visual display segment for the progressive jackpot 602 increments additions to the jackpot from wagers made into the side bet game or decrements with payouts from the progressive jackpot when matches with a level of correspondence occur in the play of the side bet wager progressive jackpot game. The last frame 606 of the progressive jackpot meter 602 is shown advancing from a value of five (5) cents to six (6) cents. The rank of the poker hand shown on the match card hand visual display 604 is four-of-a-kind (four deuces) and, irrespective of the rank of that match card hand, would receive a fixed jackpot payout amount only if at least a selected level of correspondence exists between this match card hand and the hand of a player (not shown). If the level of correspondence is sufficiently high, the payout for that level of correspondence would decrease the total amount of award available in the progressive jackpot, with the lower amount then being shown on the panel 600 within the progressive jackpot display frames 602. The progressive jackpot is likely to be decremented for all hands above at least a certain level of payout, such as card hands which have a level of correspondence of matching at least three of five symbols displayed.

The play of different types and formats of card or symbol games may add many options to the point or scope of the side bet wagering game. For example, Pai Gow poker allows a player's 'hand" to be split into two playable segments. A match card game according to the present invention may be played with either segment, or both segments at the election of the player. Preferably, however, the five card Pai Gow poker hand, regardless of the outcome in the underlying Pai Gow poker game, is used to play the side bet game. Similarly with games where common cards or match cards may be combined with a number of player cards in the game (e.g., Double Down Stud, Let It Ride™ Poker, etc.), a player may again elect to have the match card side bet game associated with cards dealt only to a specific player, cards dealt only to a dealer or house, or combinations of player cards and dealer's cards.

FIG. 6 shows an apparatus for playing a preferred progressive method of the present invention. The gaming table 450 is equipped with six player locations 451, 452, 453, 454, 455 and 456. Each player location is equipped with a number of betting locations 457, 458 for placing an initial bet and an optional ante bet, and an area 459 is identical in each player location, and is preferably equipped with an electronic bet detection apparatus. A microprocessor (not shown) receives a signal from the bet detector and activates a light (not shown) indicating a bet has been placed.

A progressive jackpot meter 460 is mounted to the table. The meter is electrically connected to the microprocessor. As bets are placed, the progressive display 461 of the display 460 increments meters 460.

The match card hand is also preferably displayed in the match card area 462 of the meter 460. Preferably, the meter 460 increments with each wager, and decrements for all payouts for 3 card matches or better. If the top progressive prize is, paid, the meter is preferably reset at $20,000.

The screen displays of the meter 460 is preferably a LED display. Alternatively, the display can be any monitor, CRT, LCD, plasma screen, or other visual display.

Figure 4:
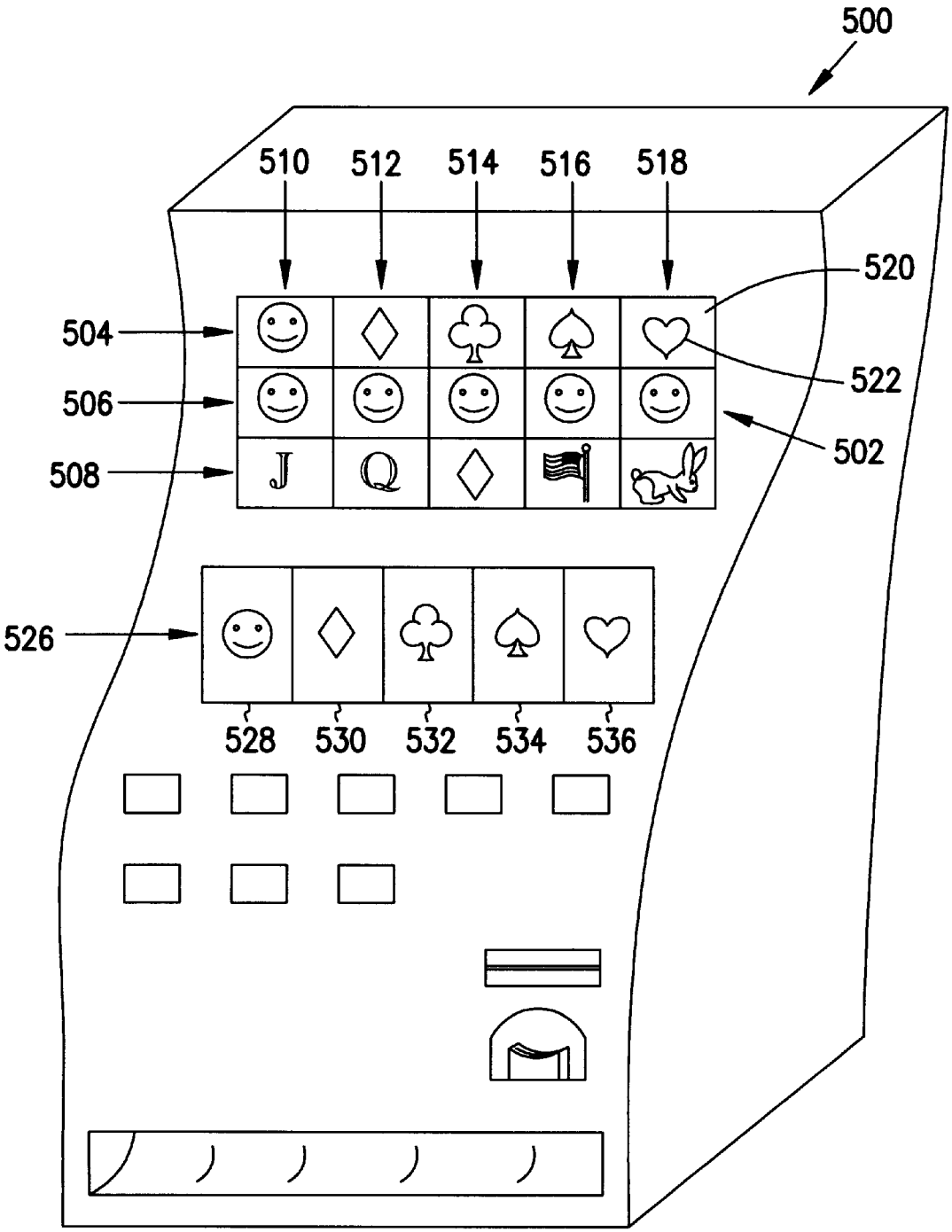
FIG. 4 shows a video apparatus displaying a match symbol play of an underlying video game according to one aspect of practice of the present invention.

FIG. 4 shows an aspect of play of the game within a video format where non-card symbols are displayed. A video gaming apparatus 500 is shown with a display or monitor 502 having three rows 504, 506 and 508 and three columns 510, 512, 514, 516 and 518 creating frames (e.g., 520) which contain symbols (e.g., a heart 522). In the displayed gaming apparatus 500, an underlying video game has been played, with the three rows 504, 506 and 508 displaying the assigned symbols with which an underlying game has been played. At any time before, during or after play of the underlying game, a wager may be made on a side bet matching game. Once a wager on a side bet game has been made (or where a player may be given an option before play of any part or all of the underlying game to see all or a portion of the symbols to be matched), the symbols to be matched 528, 530, 532, 534 and 536 may be displayed, that is randomly generated and shown on the area 526 for display of the symbols to be matched 528, 530, 532, 534 and 536. As noted, it is typical for the wager on the side bet game to be made before these symbols to be matched 528, 530, 532, 534 and 536 are displayed. However, these symbols to be matched 528, 530, 532, 534 and 536 may be shown to a player before a wager has been made on the side bet game when no symbols have been assigned to a player in the underlying game, or fewer symbols have been shown to a player than are required for a level of correspondence needed for an award to be made in the play of the side bet game.

In FIG. 4, various levels of correspondence between the three rows 504, 506 and 508 displaying the assigned symbols with which an underlying game has been played can be considered with respect to the row 526 of symbols to be matched 528, 530, 532, 534 and 536. Row 504 shows complete correspondence with respect to all five symbols and the position of the five symbols. That is a complete level of correspondence with shape and position (and not shown, color) identically matched. The center playing row 506 shows five smiley faces. The row 526 of symbols to be matched 528, 530, 532, 534 and 536 shows only one smiley face 528, so that center row 506 would have a level of correspondence with the row 526 of symbols to be matched 528, 530, 532, 534 and 536 of 1 corresponding symbol in an identical position. This might be valued as a specific level of correspondence for purposes of a subsequent award. That is, matching a symbols may be worth one virtual point and matching an identical position might be worth an additional virtual point. On the other hand, bottom row 508 shows five symbols in which there is only one symbol (the diamond in row 508 and column 514) which is the same as a symbol in the row 526 of symbols to be matched 528, 530, 532, 534 and 536. The level of correspondence between the assigned symbols in a players hand represented by row 508 with the row 526 of symbols to be matched 528, 530, 532, 534 and 536 is a single identical symbol, but without any correspondence of position. The diamond in row 508 and column 514 matches the shape but not the position of the diamond in frame 530 of the row 526 of symbols to be matched 528, 530, 532, 534 and 536. This could be assigned any artificially predetermined level of correspondence such as one virtual point for the identity of the symbol without its position being matched. The level of correspondence as used in the practice of the present invention may include any comparison of symbols and their attributes which a manufacturer may consider. For example, the smiley faces in center row 506 may have different colors so that any attributes of correspondence may include shape, color, position, size (e.g., smaller, larger or same size symbols), suits, and any other attribute which may be seen in a symbol. With a deck of cards, for example, a seven may be matched by value (e.g., any seven), by color (red sevens and black sevens), by suit (spades, hearts, diamonds and clubs), and position. Other attributes within the design of the cards such as one-eyed jacks or "suicide" kings may receive special awards or bonus points for matching any level of correspondence with the row 526 of symbols to be matched 528, 530, 532, 534 and 536.

The evaluation and probabilities of levels of correspondence will vary with many aspects of the play of an underlying game. For example, if an underlying game was blackjack, the number of decks in the shoes significantly alters potentials for levels of correspondence and requires significant consideration of the source of the match card symbols (or cards in this case). For example, if the underlying blackjack game was played with a single deck (as is conventional with video blackjack), there could never be a duplication of cards (e.g., two ten of diamonds). When multiple decks are used, such as the two, four and six deck shoes common in casinos, it is possible for even the first two cards in a player's hand to be identical. It is then necessary to consider how the random distribution of symbols (cards) for the side bet matching game are to be provided. For example, the side bet matching symbols (cards) should be able to provide a complete match of symbols which are put into play for the player. Where a player may receive identical symbols for his/her play of the underlying game, the provision of the match card side bet game should also be enabled to present identical symbols for each element of the hand. Therefore, where the underlying game of, for example blackjack, uses multiple decks which enable identical cards to be provided as the first two cards (or any other number of cards), the house or manufacturer of the game must either decide to exclude such hands with an identical set of first two cards from possible side bet match hands (by using a single deck as the source of the cards to be matched) or provide a number of decks from which the matching cards are provided so that the set of cards which are to be matched may include the ability to provide two or more identical first cards.

An example of a table defining a level of correspondence with symbols is represented below.

| Virtual Points Awarded for Each Type of Correspondence | Points |
|---|---|
| Correspondence Feature | |
| Same Symbol without Corresponding Position | 1 |
| Same Symbol with Corresponding Position | 2 |
| Two Same Symbols without Corresponding Position | 3 |
| Two Same Symbols One With and One Without Corresponding Positions | 5 |
| Two Same Symbols Both With Corresponding Positions | 10 |
| Three Same Symbols Without Corresponding Position | 10 |
| Three Same Symbols One With and Two Without Corresponding Positions | 15 |
| Three Same Symbols Two With Corresponding Positions One Without Corresponding Position | 25 |
| Three Same Symbols With Corresponding Position | 50 |
| Four Same Symbols Without Corresponding Position | 25 |
| Four Same Symbols One With and Three Without Corresponding Positions | 50 |
| Four Same Symbols Two With Corresponding Positions Two Without Corresponding Position | 100 |
| Four Same Symbols Three With Corresponding Positions One Without Corresponding Position | 250 |
| Four Same Symbols With Corresponding Positions | 500 |
| Five Same Symbols Without Corresponding Position | 250 |
| Five Same Symbols One With and Four Without Corresponding Positions | 400 |
| Five Same Symbols Two With Corresponding Positions Three Without Corresponding Position | 700 |
| Five Same Symbols Three With Corresponding Positions Two Without Corresponding Position | 1000 |
| Five Same Symbols Four With Corresponding Positions One Without Corresponding Position | 5000 |
| Five Same Symbols With Corresponding Positions | 25000 |

The Points in the table may represent a multiple of any side bet wager. The points may also be replaced with percentages of a progressive jackpot, or partially replaced with percentages of a progressive jackpot, with some hands being paid fixed amounts out of the progressive jackpot or paid independently by the house. Additional levels of correspondence may also be included within a table, such as color (e.g., where a certain number of matching symbol shapes and/or positions also correspond in color). Awards are based upon any predetermined level of correspondence designed or designated by the manufacturer of the game. The awards will be based upon an appropriate consideration of probabilities, statistics, rate of return to the player and profit margins for the casinos. Jackpot payouts, progressive jackpot payouts and the like may be associated with predetermined levels of correspondence of symbols in an underlying game with a row 526 of symbols to be matched 528, 530, 532, 534 and 536.

Another example of a payout schedule or table which may be used in the play of the Match Symbol side bet game of the present invention with a maximum potential for five matches, irrespective of position, suit or the like could be

| No. Of Matches | Payout |
|---|---|
| 2 | 5 |
| 3 | 45 |
| 4 | 2% of Progressive |
| 5 | 100% of progressive |

When the maximum award in the progressive jackpot is won (a 100% payout of the progressive jackpot), the level of award for the progressive jackpot is reset at a base amount such as $20,000. Decrements in this jackpot for awards less than 100% (e.g., for matches of at least three symbols out of five) may or may not be allowed to reduce the jackpot below this base amount, at the choice of the casino or manufacturer.

The side bet game may be played with any variation of symbol providing reel or video game, with any format of the various games known or considered for play in the wagering field. For example, the side bet game may be played with standard three, four and five column reel slot or reel slot video games, with the side bet game placed at an appropriate time as discussed above. Variations of reel or reel video games where individual frames within a player's hand are assigned in portions of less than the whole hand may also be played in conjunction with the side bet game of the present invention. For example, where the underlying game assigns frames in a row or rows, one-at-a-time, the side bet game may be initiated before or after any or all symbols are assigned, and after or before any wagers on the underlying game are made.

The game has been particularly described with respect to poker games, but any game in which symbols are randomly provided from a set or collection of symbols (e.g., roulette, craps, blackjack, reel slot videos, blackjack, Mah Jong, dominoes, and the like) may also be used in combination with the practice of the present invention. Twenty-One or blackjack is particularly amenable to the present invention in a video format. Special jackpots may be awarded for matching pat hands, blackjacks, five card hands, and the like. Again, the wagers on the match card side wager game may be made at any time before, during or after play of the underlying game.

In many live games and/or video games, symbols may be selected from different types of collections or sets of symbols. For example, the frequency of particular symbols on a reel, on tiles, on dice, in software, or in cards can be varied to adjust the odds, hit frequencies and probabilities in the play of games. Games may be played with the frequency of events or occurrences predesigned and controlled by the manufacturer, or simply modified by altering the content of the source of symbols. In the simplest consideration, play of card games (particularly an underlying card game) may be performed with a single deck, multiple decks (e.g., two, three, four, six or eight decks), modified decks (e.g., deuces removed, jokers added, special decks [e.g., canasta and Spanish deck]) or additional nines added) and the like. The same considerations may be made with any game using symbols, as where five dice are provided where some symbols are removed from some of the dice and other symbols are added to increase, decrease or otherwise modify the frequency or chance of particular symbols appearing. The reels on slot machines have always been designed with certain symbols being repeated on the reel more often and therefore allowing those symbols to appear more frequently than others. The same considerations are given in video gaming equipment except that, instead of the symbol being present more often, the software is provided with varying selection frequencies for each of the symbols, and the selection frequencies for the various symbols may be varied, from symbol to symbol, virtual reel to virtual reel.

Within a reel or virtual reel, the programmed distribution frequency of a symbol may be varied as desired. In a reel, for example, a symbol may appear once (e.g., a frequency of 1 within the reel), twice (a frequency of 2 within the reel) or more often. With the software used in video gaming apparatus, the frequencies may be even more particularly specified and controlled beyond unit frequencies. For example, with 100 virtual symbols available within a single virtual column, the frequency for a symbol associated with the most valuable combination of symbols in an underlying game may be adjusted to affect the frequency of that most valuable combination appearing. For example, the symbol may be programmed to have a frequency of 1, greater than 1, or less than 1.

Video apparatus embodying games of the present invention may be readily prepared by those of ordinary skill in the art. Where the side bet game of the present invention is to be played in a purely video format (as opposed to an exclusively live player version or combination of live player play with physical symbols and video activity), apparatus and systems for performing the method of the present invention may comprise the following components. A gaming apparatus may be provided which has at least one computer having hardware and software enabling it to perform the information and data handling functions of the play of the underlying game and the side bet game of the invention. The hard drive capacity and memory are well within the ability of one skilled in the art to appropriately select the boards and chips for use with the apparatus, the basis of selection being dependent on the desires of the manufacturer for speed, image quality, durability, and the like. An alternative simplified structure which would enable play of the side bet game of the invention could also include a personal computer comprising hardware with embedded software (e.g., a processing unit), a keyboard, a monitor, and a pointing or directing device (e.g., a mouse, tracking ball, keyboard functions or screen contact or response systems which react to pressure, electrostatic changes or radiation changes [e.g., light] on the monitor screen). Essentially any computing device with sufficient speed to hold the software and perform the processing necessary for the play of the underlying game and the side bet game can be used in the practice of the present invention.

With regard to the play of a game according to a practice of the present invention, a sequence of play with live players at a live casino game (with the term 'cards' being considered generic to symbols) may proceed as follows:

a) players have the option of placing a side bet wager on a sensor (optional) or in a token acceptor at any authorized time (as described above) during the game. If a light indicator is associated with the sensor, a visually observable light response (e.g., such as a flashing light) will occur after recognition of the side bet wager;

b) the sensed bet may be directly registered within associated apparatus or the dealer will press a "register" key on a key pad to which the dealer has access. In preferred equipment, the flashing light will become a steady light source (e.g., a red light). As bets are made at the various available times during play of the game, bets can be re-registered and additional recognition or registration lights can be added to the display at the table. As noted above, the side card bet may be made at any time, including after one complete hand has been displayed, but before either partial or complete display of the second hand (the two hands including a player's hand and a match card hand);

c) even after the basic (underlying) game has been settled, the dealer may ask for additional side bet wagers or entries. After re-registering later side bet wagers, the dealer will indicate (e.g., verbally or by a signaling a locking device) that there will be "No more bets." At this point, a "Match Cards" key may be pressed on the dealer's key pad. No more side bets will be accepted and the match card hand(s) will be displayed, e.g., on an LED panel in front of each player or with a single panel displaying the match card hand on the gaming table against which all player hands are to be matched;

d) the dealer will then pay the winners (no key pad entry is needed) for one, two, three, four or five matches (with a key generally needed for security with higher levels of awards, such as three or more matches). After keypad identification of a high level of match, a security key may have to be used by a casino employee of sufficient authority (e.g., a pit boss or area manager or casino manager for highest level awards). After each payout, a dealer may press a 'clear' key to register payment to a specific player from a specific hand or game. After all hands are settled, the dealer will press a 'game over' key, coin sensors (if any) will shift to a light orientation indicating that no wager has been placed (e.g., usually dark) or that coins have already been placed on a sensor (e.g., a light system or light indicator will blink or shift colors), and the match card display (e.g., the 5 cards on the LED display panel) will no longer reveal the faces of the cards, as by 'turning over' to display the backs of the cards. Even if none of the players engages in a side bet, the dealer may have to press the "Match Card" and "Game Over" keys to record the hands dealt or the number of games played, especially if there is a shuffling machine connected to the keypad. If the entire game is hand dealt, without the use of electronic apparatus, the above steps relating to the electronic apparatus would not have to be used.

The match symbol side bet game of the present invention may also be played in combination with other side bet games or multiplier features associated with table games or video gaming apparatus. For example, the side bet match symbol game may be played in conjunction with the symbols provided in the Let-Em-Spin™ game which can be played at gaming tables and gaming video apparatus. In the live table play of Let-Em-Spin,™ the live table has, for example, a single, four-reel slot mechanism which is built into the surface of the gaming table. The players place a wager on the occurrence of symbol matches (preferably predetermined) which are identified on a pay table. The reels are put into motion (usually all four reels at the same time, but variations may be made in the reel spinning). Usually two of the four reels stop, and based on this information on the partial potential of the final four reel display, the players can increase their initial wager, within defined limits. One player is selected to hit the "stop" button located at the player's position at the table. When the "stop" button is hit, the last two reels stop spinning and the last two symbols in the set of four symbols are displayed. Each player is awarded a payout corresponding to the bet placed and the pay table.

With a multi-reel video apparatus, any type of symbol set for the reels may be provided.

For example, one format of four reels for Let-Em-Spin™ is shown below:

| Symbol | Reel 1 | Reel 2 | Reel 3 | Reel 4 |
|---|---|---|---|---|
| Red 7 | 20 | 25 | 3 | 4 |
| White 7 | 17 | 11 | 14 | 8 |
| Blue 7 | 14 | 14 | 25 | 31 |
| Single Bar | 30 | 24 | 18 | 29 |
| Double Bar | 20 | 18 | 13 | 11 |
| Triple Bar | 10 | 17 | 11 | 11 |
| Blank | 17 | 19 | 44 | 34 |
| | 128 | 128 | 128 | 128 |

The frequency may be adjusted by the manufacturer or programmer as desired. Once the Let-Em-Spin™ game has been played, the Match Card side bet game of the present invention may be played. The side bet game of the invention may also be entered by a wager before any of the four reels begin spinning, after one or more of the reels has begun spinning, when all of the reels are spinning, when one or more of the reels has stopped spinning, or when all of the reels have stopped spinning, either before or after settlement of the wager and payout in the Let-Em-Spin™ game.

These and other aspects of the invention, without limitation, can be practiced by the skilled artisan in the gaming technology trade. The examples, symbols, games, and sequences herein are exemplary only and may be varied by one of ordinary skill in the art.

What is claimed is:

1. A method of playing both an underlying game and a side bet game comprising the steps of:

a) playing an underlying game in which at least one card is received and at least one card is kept by a player at the end of an underlying game and at least one wager is placed by the player on the underlying game, b) a player in the underlying game placing a wager on a side bet game, c) providing to the view of the player at least one randomly generated card which becomes a part of said side bet game, d) comparing said at least one card kept at the end of the underlying game to the at least one randomly generated card which becomes part of the side bet game, and e) determining a level of correspondence between said at least one card kept at the end of the underlying game and the at least one randomly generated card which becomes part of the side bet game.

2. The method of claim 1 wherein said wager is placed on said side bet game before any cards are received by said player.

3. The method of claim 1 wherein said wager is placed on said side bet game after at least one card is received by said player.

4. The method of claim 1 wherein said wager is placed on said side bet game after at least one card is viewed by said player.

5. The method of claim 1 wherein said wager is placed on said side bet game after all cards used by a player in play of the underlying game have been received by said player.

6. The method of claim 1 wherein said wager is placed on said side bet game after all cards used by a player in play of the underlying game have been viewed by said player.

7. The method of claim 1 wherein said wager is placed on said side bet game after conclusion of play of the underlying game.

8. The method of claim 1 wherein said wager is placed on said side bet game after conclusion of play of the underlying game and after payment of awards in said underlying game.

9. The method of claim 1 wherein the level of correspondence comprises matching suit.

10. The method of claim 1 wherein the level of correspondence comprises matching rank.

11. The method of claim 1 wherein the level of correspondence comprises matching suit and rank.

12. The method of playing both an underlying game and a side bet game according to claim 1 wherein after determining a level of correspondence between said at least one card kept at the end of the underlying game and the at least one randomly generated card which becomes part of the side bet game, comparing that level of correspondence to a look-up table.

13. The method of claim 12 wherein after comparing that level of correspondence to a look-up table, a rate of award to be provided to that level of correspondence is identified.

14. The method of claim 13 wherein after a rate of award to be provided to that level of correspondence is identified, an indication of a total amount of award or bonus is indicated to the player.

15. The method of claim 9 wherein said wager on said side bet game is placed before or at the same time as a wager on the underlying game.

16. The method of claim 9 wherein said wager on said side bet game is placed after at least one card is received by the player.

17. The method of claim 13 wherein said wager on said side bet game is placed after at least one card is received by the player.

18. The method of claim 1 wherein said wager on said side bet game is placed after at least two cards are received by the player.

19. The method of claim 16 wherein said wager on said side bet game engages the player in an opportunity to be a contestant in a progressive jackpot.

20. The method of claim 17 wherein said wager on said side bet game engages the player in an opportunity to be a contestant in a progressive jackpot.

21. The method of claim 1 wherein said underlying game is stud poker with at least five cards received by the player in the underlying game.

22. The method of claim 21 wherein in said underlying stud poker game at least five cards and no more than seven cards are received by the player in the underlying game, and at least three randomly generated cards which become part of the side bet game are provided after or when a side bet wager is made.

23. The method of claim 16 wherein said underlying game is five card stud poker, and at least three randomly generated cards which become part of the side bet game are provided after or when a side bet wager is made.

24. The method of claim 17 wherein said underlying game is five card stud poker, and at least three randomly generated cards which become part of the side bet game are provided after or when a side bet wager is made.

25. The method of claim 16 wherein said underlying game is five card stud poker, and five randomly generated cards which become part of the side bet game are provided after or when a side bet wager is made.

26. The method of claim 17 wherein said underlying game is five card stud poker, and five randomly generated cards which become part of the side bet game are provided after or when a side bet wager is made.

27. The method of claim 24 wherein said wager on said side bet game engages the player in an opportunity to be a contestant in a progressive jackpot.

28. The method of claim 25 wherein said wager on said side bet game engages the player in an opportunity to be a contestant in a progressive jackpot.

29. The method of claim 26 wherein said wager on said side bet game engages the player in an opportunity to be a contestant in a progressive jackpot.

30. A method of playing both an underlying game and a side bet game comprising the steps of:

a) playing an underlying game in which at least one symbol is received and at least one symbol is kept by a player at the end of an underlying game and at least one wager is placed by the player on the underlying game, b) a player placing a wager on a side bet game, c) providing to the view of the player at least one randomly generated symbol which becomes a part of said side bet game, d) comparing said at least one symbol kept at the end of the underlying game to the at least one randomly generated symbol which becomes part of the side bet game, and e) determining a level of correspondence between said at least one symbol kept at the end of the underlying game and the at least one randomly generated symbol which becomes part of the side bet game.

31. The method of claim 30 wherein said symbols are playing cards or replications of playing cards.

32. The method of claim 31 wherein at least five cards are kept by a player at the end of the underlying game.

33. The method of claim 32 wherein said underlying game comprises five card stud poker or five card draw poker.

34. The method of claim 33 wherein the player has an option of placing a wager on the side bet game before receiving any cards, after receiving at least one card, and after completing play of the underlying game.

35. The method of claim 30 wherein said side bet game comprises a match card side bet game in which providing to the view of the player at least one randomly generated card which becomes a part of said side bet game comprises providing five cards to the view of the player.

36. The method of claim 30 wherein wagering on the side bet game engages the player in a progressive jackpot.

37. The method of claim 31 wherein wagering on the side bet game occurs after at least one of the cards exposed to the view of the player during play of the underlying game has been exposed.

38. The method of claim 1 wherein play of an underlying game provides at least two groups of cards selected from the group consisting of one hand of a player, two hands of a player, dealer's hand, and common cards, and wherein a wager on said side bet game is made on only one of said at least two groups.

39. The method of claim 38 wherein said wager on said side bet game is made on at least two of said at least two groups.

40. A method of playing a side bet game in connection with an underlying game, comprising the steps of:

a player placing a wager to participate in an underlying wagering game, the underlying wagering game including the step of randomly assigning a plurality of game symbols to the player;

the player playing the underlying game to resolution, wherein at a conclusion of play of the underlying game, the player holds a first set of game symbols;

awarding the player a payout if the player achieves a winning outcome in the underlying game;

providing a second set of randomly selected game symbols to participate in the side bet game;

the player placing an optional wager at any time up until both the first set of game symbols and the second set of game symbols are revealed to the player;

determining a level of correspondence between the first set of game symbols and the second set of game symbols; and awarding a payout for the level of correspondence between the first set of game symbols and the second set of game symbols.

41. A method of playing a side bet game in connection with an underlying game, comprising the steps of:

a first player placing a wager to participate in an underlying wagering game, the underlying wagering game including the step of randomly assigning a plurality of game symbols to the player;

the first player playing the underlying game to resolution, wherein at a conclusion of play of the underlying game, the player holds a first set of game symbols;

awarding the first player a payout if the player achieves a winning outcome in the underlying game;

providing a second set of randomly selected game symbols to participate in the side bet game;

either the first player, a second player who is not a participant in the underlying game, or both the first and second player placing an optional wager at any time up until both the first set of game symbols and the second set of game symbols are revealed to the first player and/or second player;

determining a level of correspondence between the first set of game symbols and the second set of game symbols; and awarding a payout to said first player and/or said second player for the level of correspondence between the first set of game symbols and the second set of game symbols.

42. A video wagering device for play of a video wagering game having at least an underlying game and a side bet wager game, comprising:

a cabinet;

a screen display mounted in the cabinet;

player controls mounted in the cabinet;

a device for receiving wagers mounted in the cabinet;

a payout device for paying player winnings mounted in the cabinet;

a microprocessor located within the cabinet, RAM and ROM memory, where a program is stored in the ROM memory which comprises a video wagering game with at least a first underlying game in which symbols or cards are provided to a player and a second side wager game in which symbols or cards are revealed and a level of correspondence between a) the symbols or cards provided to a player and b) the symbols or cards revealed is determined, wherein the program generates a first screen display corresponding to the symbols or cards provided to a player and a second screen display corresponding to the symbols or cards that are revealed, wherein player instructions received from the player controls are stored in RAM, wherein an award is determined and then provided to the player when a level of correspondence between the a) the symbols or cards provided to a player and b) the symbols or cards revealed has been indicated by the program to receive an award; and data bus means between the microprocessor and screen display, player controls, device for receiving wagers and payout device.

43. The device of claim 42 wherein the microprocessor is programmed to play a poker game as the underlying game.

44. The method of claim 30 wherein said underlying game comprises Let-It-Spin™ casino game.

45. The method of claim 40 wherein said underlying game comprises Let-It-Spin™ casino game.

46. The method of claim 39 wherein said underlying game comprises Let-It-Spin™ casino game.

47. The method of claim 40 wherein said underlying game comprises Let-It-Spin™ casino game.

48. The method of claim 1 wherein placing a wager on a side bet game occurs after the player has folded his hand.

49. The method of claim 1 wherein placing a wager on a side bet game occurs after a dealer's hand has been folded.

50. The method of claim 1 wherein at least two cards are received and at least two cards are kept by a player at the end of the underlying game and at least two cards are randomly generated as match cards which becomes part of said side bet game.

51. The method of claim 1 wherein said wager is placed on said side bet game before revealing any randomly generated cards on the side bet game to the player.

52. The method of claim 13 wherein the rate of award is progressive.

53. The method of claim 13 wherein the rate of the award is proportional to the amount of the side bet wager.

54. A method of playing both an underlying game and a side bet game comprising the steps of:

a) playing an underlying game in which at least two symbols are received and at least two symbols are kept by a player at the end of an underlying game and at least one wager is placed by the player on the underlying game, b) a player placing a wager on a side bet game, c) providing to the view of the player at least two randomly generated symbols which become a part of said side bet game, d) comparing said at least two symbols kept at the end of the underlying game to the at least two randomly generated symbols which become part of the side bet game, and e) determining a level of correspondence between said at least two symbols kept at the end of the underlying game and the at least two randomly generated symbols which become part of the side bet game.

* * * * *